United States Patent [19]

Asai et al.

[11] Patent Number: 5,013,408

[45] Date of Patent: May 7, 1991

[54] DECARBONIZATION APPARATUS FOR COKE OVEN CHAMBER

[76] Inventors: Keniti Asai; Hideaki Ito; Yoji Nakagawa; Yasutaka Shihara; Toshiaki Hodate; Akikazu Nakazaki, all of c/o Nippon steel Corporation, Yawata Works, 1-1-1, Edamitsu, Yahatahigashi-ku, Kitakyushu-shi, Fukuoka-ken, Japan

[21] Appl. No.: 287,626

[22] Filed: Dec. 20, 1988

Related U.S. Application Data

[63] Continuation of Ser. No. 97,265, Sep. 17, 1987, abandoned, which is a continuation of Ser. No. 817,598, Jan. 10, 1986, abandoned.

[30] Foreign Application Priority Data

Jan. 9, 1986 [JP] Japan ..... 61-2742
Jan. 9, 1986 [JP] Japan ..... 61-2743

[51] Int. Cl.[5] ..... C10B 43/12
[52] U.S. Cl. ..... 202/241; 15/316 R
[58] Field of Search ..... 202/241; 201/2; 196/122; 15/316 A, 316 R, 317, 318; 134/20, 29

[56] References Cited

U.S. PATENT DOCUMENTS

| | | | |
|---|---|---|---|
| 49,989 | 9/1865 | Edge | 202/241 |
| 169,628 | 11/1876 | Davison | 202/241 |
| 1,862,028 | 6/1932 | Lovett | 202/241 |
| 2,239,412 | 4/1941 | Curran | 202/241 |
| 2,391,443 | 12/1945 | Bruton | 202/241 |
| 3,964,976 | 6/1976 | Pettrey et al. | 201/2 |
| 4,080,220 | 3/1978 | Neumann | 202/241 |
| 4,366,004 | 12/1982 | Gregor et al. | 202/241 |

FOREIGN PATENT DOCUMENTS

| | | | |
|---|---|---|---|
| 167677 | 10/1983 | Japan | 201/2 |

*Primary Examiner*—Joye L. Woodard

[57] ABSTRACT

A decarbonization apparatus for a coking chamber of a coke oven, which comprises a lance connected to an oxygen-containing gas pressure source, and a support for supporting and inserting the lance into the coking chamber. The lance has at least one nozzle projecting therefrom in such manner that the gas ejected therefrom flows almost parallel to the side wall of the coking chamber.

4 Claims, 8 Drawing Sheets

DECARBONIZATION APPARATUS FOR COKE OVEN CHAMBER

This is a continuation of application Ser. No. 07/097,265, filed Sept. 17,1987, now abandoned, which is a continuation of application Ser. No. 06/817,598, filed Jan. 10, 1986, also abandoned.

BACKGROUND OF THE INVENTION

1. Field of the Invention

The present invention relates to decarbonization of the coking chamber of a coke oven, more particularly an apparatus for removing the carbon deposition on the inside of the coking chambers.

2. Description of Prior Arts

In coke production in coke ovens, carbon deposits on all parts of the coking chamber during the coking period and if this carbon deposition, particularly on the inside walls of the coking chamber, is allowed to accumulate, it hinders the pushing-out operation of the produced coke through the chamber, decreases the effective dimensions of the chamber, and causes lowering in the thermal conductivity of the chamber walls and the adverse effects on the coke production. Therefore, the carbon deposition on the inside walls of the coking chamber must be removed periodically. Meanwhile, if the carbon deposition on the upper inside wall (ceiling surface) of the coking chamber is allowed to accumulate, it hinders the levelling operation of the coal charges, and this carbon deposition also must be removed periodically. Also the carbon deposition on the root portion and the rising portion of the ascension pipe, if allowed to accumulate, hinders the outlet of the generated gases, and must be removed periodically. In the conventional arts, as taught by Japanese Patent Publication No. Sho 60-2348, it has long been a common practice for the removal of the carbon deposition on the inside walls of the coking chamber that a spear-like tool of about 5 to 6 meters in length, with a pointed tip, is used for manually stripping off the carbon deposits from above the coking chamber. This practice, however, has been confronted with various problems such that the carbon deposition layer is completely stripped off from the walls without leaving the least carbon deposition necessary for sealing the wall refractory joints, the workers are exposed to a high temperature and heavy muscular labor and that the oven operation must be stopped during the stripping off of the carbon deposits. Further, for the removal of the carbon deposits on the ceiling surface or on the upper portions of the side walls of the coking chamber, which are at the dead angle from above the coking chamber, it is difficult to strip them off by the conventional practice.

In substitution of the above conventional practice, it has been proposed to liberate the coal charging holes and the ascension pipe about one hour before the pushing-out of the coke to introduce air into the chamber by a natural ventilation for combustion of the carbon deposits. However, the introduction of air about one hour before the pushing-out of the coke from the chamber has economical and technical problems that much of the oven gas is wastefully discharged together with the introduced air through the ascension pipe, because the oven gas is still generated at a rate of about 3 to 5 $Nm^3$/Hr.Coal t. (4800 Kcal/$Nm^3$) at this stage, and that the coal charging holes and portions nearby are unduely cooled by the introduced air and very susceptible to damages such as by spalling.

For removal of the carbon deposits on the root portion and rising portion of the ascension pipe, the conventional practice is that in addition to the above-mentioned introduction of air through the coal charging holes, the levelling bar hole is liberated before the pushing-out of the coke to introduce air therethrough for combustion of the carbon deposit and the carbon deposit is mechanically sticked off by a tool from through the levelling bar hole or through the top hole of the rising portion of the ascension pipe. All of these practices have been confronted with the problem that the oven gas generating during these decarbonization operations is discharged from the coking chamber.

SUMMARY OF THE INVENTION

Therefore, the object of the invention is to provide a decarbonizing apparatus which can remove by combustion undesirable excessive carbon deposits on all parts of the coking chamber without locally cooling the chamber and without pause of the coke pushing and charging operation, with less labor, but leaving a necessary amount of carbon deposit for sealing the refractory joints of the coking chamber walls.

The decarbonizing apparatus according to the present invention comprises a lance connected to an oxygen-containing gas pressure source, support means for supporting and inserting the lance into the coking chamber, said lance having at least one nozzle projecting therefrom in such a manner that the gas ejected therefrom flows almost parallel to the side walls of the coking chamber.

According to a modification of the apparatus according to the present invention, the gas pressure source is connected on the suction side to a hole bored through the coking chamber to take out part of the gas in the coking chamber.

According to a further modification of the apparatus according to the present invention, the lance is connected to a stationary gas pressure source by means of a flexible pipe and coupler, or by means of a flexible tube which is wound or rewound around a winding machine as the car moves.

DETAILED DESCRIPTION OF THE INVENTION

The present inventors have made extensive studies and experiments and made the following discoveries.

That the carbon deposits on the whole inside walls of the coking chamber can be effectively removed by ejecting oxygen gas or a gas containing oxygen into the chamber from through at least one gas ejection lance inserted thereinto through an opening of the chamber and by circulatorily stirring the gas along the side walls of the chamber, and that the undesirable excessive carbon deposition can be effectively removed without damaging the sealing of the refractory joints of the chamber walls which is critically important to the coking chamber and without lowering the inside temperature of the chamber wholly or locally, while maintaining a constant concentration of soot in the waste gas during the coal charging operation, and maintaining a constant electric current required for the pushing-out operation of the coke.

The present invention has been made on the basis of the above discoveries, and the apparatus according to the present invention can automate and simplify the process and structure, thus saving the energy and avoiding heavy muscular labor and yet can control the combustion of the excessive carbon deposition in a reliable manner According to the present invention, the ejection direction of the ejection nozzles arranged on the lance inserted into the coking chamber is oriented to be almost parallel to the side wall plane of the chamber so that the oxygen-containing gas ejected from the nozzles flows along the side walls forms a circulatory stirring flow through the inside of the coking chamber and is brought into contact with the carbon deposited on the walls of the chamber to burn and remove the carbon. Thus in the present invention the gas is not ejected directly onto the wall surfaces for the carbon removal so that the refractory joints are not damaged and only the undesirable excessive carbon deposits can be removed, leaving the necessary amount of carbon on the walls for sealing the refractory joints.

Regarding the insertion position of the ejection lance according to the present invention, it is preferable to have the lance inserted from through the upper surface of the coking chamber, but it may be inserted from through the side walls such as the coke-side and pusher-side doors of the chamber. In all cases, the nozzles are arranged on the lance depending on the lance postures in such a manner that their gas ejection direction is parallel to the side wall plane as mentioned above.

As to the supporting means for the gas ejection lance in the present invention, the lance may be adjustably supported on the existing coal charging car or on the coke pusher or the coke guide car or on a specially designed lance carrier car movable on the chamber or movable on the coke-side of the coking chamber, or movable on the pusher-side of the chamber. The lance may be otherwise supported by any suitable means. Conveniently, the lance is inserted into the coking chamber through the existing coal charging hole, but it may be inserted through a hole bored through the upper lid or the side walls of the chamber for the sole purpose of lance insertion. Also the lance may be inserted through a special sealing plate when the insertion is made horizontally from the coke-side or pusher-side.

According to a modification of the present invention, part of the oxygen containing gas ejected in a circulatory flow from the nozzles into the coking chamber is discharged or sucked out of the chamber and introduced to the gas pressure source communicating to the lance to be recirculated into the chamber. This can promote the circulatory flow of the oxygen containing gas in the chamber and contribute to raise the gas temperature into the chamber.

According to a further modification of the present invention, as the lance is connected to a stationary gas pressure source by means of a flexible pipe and a coupler which connects or disconnects the lance to the gas pressure source or by means of a flexible tube which is wound or rewound around a winding machine as the car moves, the decarbonization operation can be satisfactorily performed even when the car carrying the lances is moving, and the load on the coke oven is substantially reduced.

The present invention will be better understood from the following description of preferred embodiments with reference to the accompanying drawings.

DESCRIPTION OF THE PREFERRED EMBODIMENTS

Referring to FIG. 1, the lance 1 usable for the decarbonization of the coking chamber is composed of a cylindrical body made of, for example, steel, ceramics and the like and provided with a plurality of ejection nozzles 2 arranged equally spaced from each other over the lower half portion of the cylindrical body: The lance shown in FIG. 1(*a*) has a plurality of upwardly oriented nozzles on the middle portion and a plurality of downwardly oriented nozzles on the lower end portion of the cylindrical body. The lance shown in FIG. 1(*b*) has a plurality of upwardly oriented nozzles. The lance shown in FIG. 1(*c*) has a plurality of downwardly oriented nozzles. Depending on the purposes of the lance, the lance may have various combinations of upward, downward and horizontal nozzles. As shown in FIG. 1(*d*), the lance may have auxiliary ejection nozzles 3 or slits (not shown) on the upper end portion of the cylindrical body for removing the carbon deposition around the inside wall of the coal charging hole through which the lance is inserted into the coking chamber.

Figure 1D:
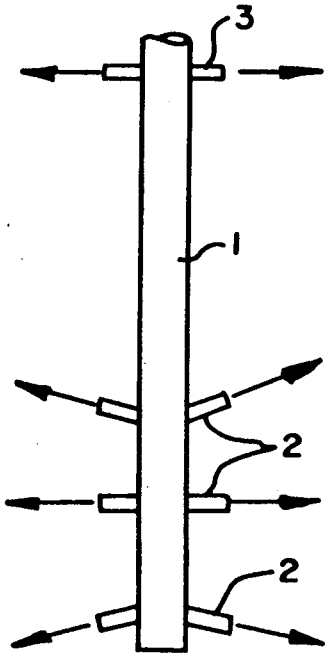
FIGS. 1(*a*), (*b*), (*c*) and (*d*) respectively show an embodiment of the gas ejection lance usable for the vertical insertion of the lance in the present invention.
Figure 1C:
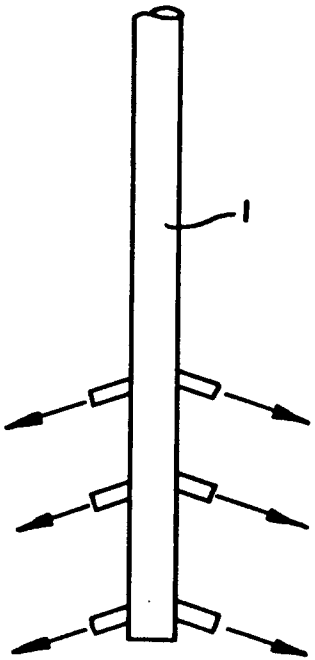
Figure 1B:
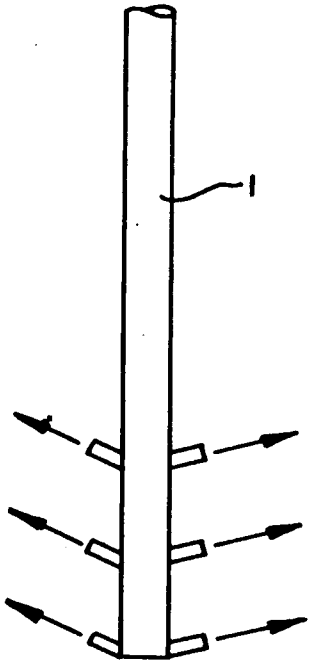
Figure 1A:
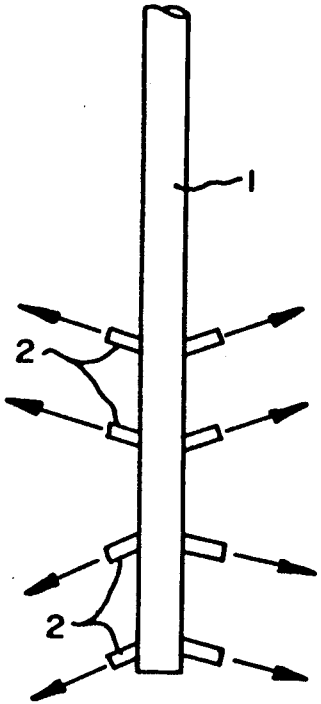
Figure 2:
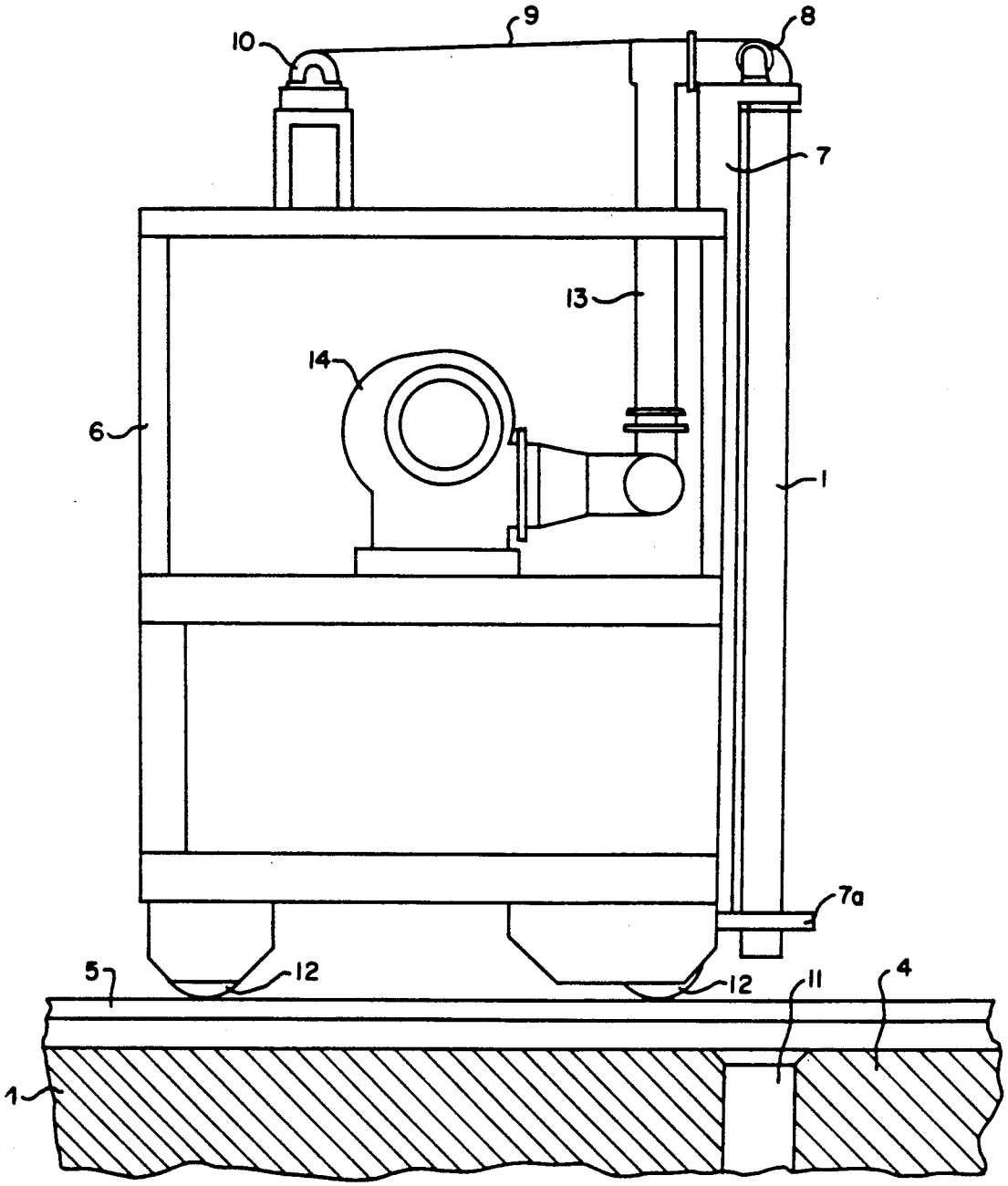
FIG. 2 shows the cross section of an embodiment of the decarbonizing apparatus according to the present invention.

In the embodiment as shown in FIG. 2, the lance is carried and supported by means of a lance guide 7 on a specially designed lance carrier car 6 having wheels 12 and driven by a driving source (not shown) on rails 5 laid on the coking chamber. The lance 1 carried on the car 6 is downwardly guided through the coal charging hole into the coking chamber and held at a predetermined position in the chamber by means of a guide pulley 8 and a wire 9 which is wound around a winding drum 10, for example, 7*a* is a stopper to be used in descending the lance 1. Further, the lance is connected to a gas pressure source 14, such as a blower or compresser, through a flexible hose (not shown) which can follow the upward and downward movements of the lance and a supply duct 13. The gas may be any gas which contains oxygen and promotes the combustion of the carbon. For example, oxygen gas or air or their mixture may be used. In cases where the temperature lowering inside of the coking chamber should be more efficiently prevented, the gas may contain a higher concentration of oxygen.

According to the present invention, the means for inserting and holding the lance is not limited to the above embodiment using the lance guide and the winding drum, but any ordinary supporting lifting device, such as a forth-and-back moving device, a turning-lifting suspension system, or a mere suspension system may be used. Also the car on which the lance is supported and carried may be an ordinary coal charging car or a specially designed car stationary, self-movable or trained by the coal charging car. The lance is inserted into the coking chamber in such a posture that the projecting direction of the nozzles is almost parallel to the side walls of the chamber and the nozzles may have any desired shape, such as oval and flat, which can provide a predetermined gas ejection and flow rate. Also the number of nozzles to be used is not limited and some of them may be clogged.

Figure 3:
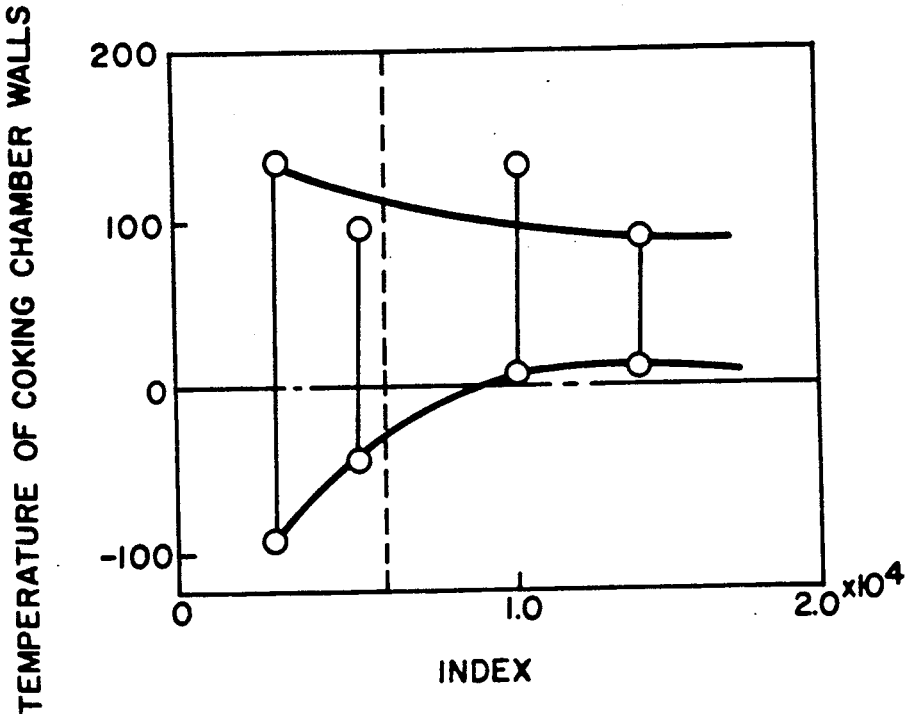
FIG. 3 is a graph showing the relation between the $\pi$ index and the wall temperature difference before and after decarbonizing of the coking chamber.
Figure 4:
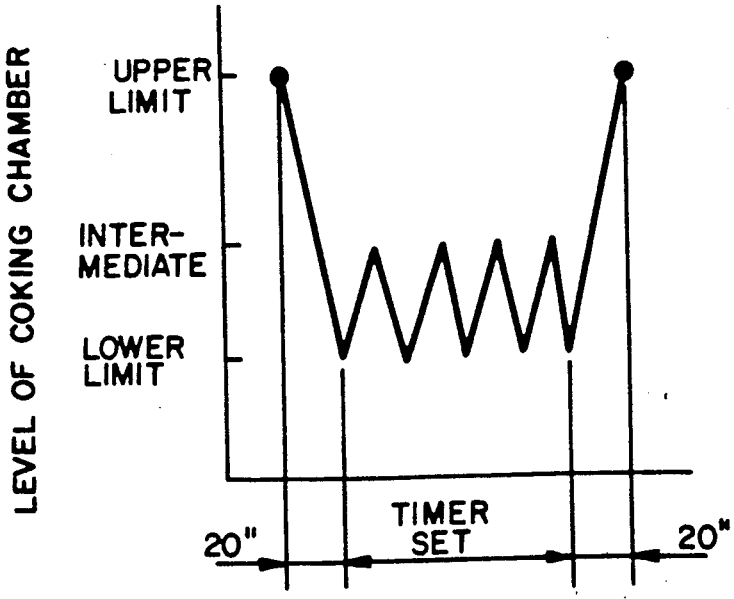
FIG. 4 shows one example of the gas ejection operation.

The decarbonizing operation of the coking chamber 4 is performed in this embodiment as below. At least one of the coal charging holes 11 is liberated and the lance or lances 1 are inserted through the liberated hole or holes into the chamber 4 to about ¼ to ¾ of the chamber depth in such a posture that the ejection direction of the nozzles is oriented parallel to the side walls of the chamber. Then an oxygen gas or a gas containing oxygen is ejected from the nozzles at a flow rate not less than 20 m/sec. to cause a circulatory stirring flow within the chamber. If the flow rate is less than 20 m/sec., the decarbonization efficiency is lowered or the decarbonization is not evenly effected. The optimum gas ejection rate varies depending on the dimensions of the chamber as shown in FIG. 3. It has been found that if the ejection rate is adjusted so as to give 0.6 or higher value of the $\pi$ index $$\left(\pi = \frac{\text{kinetic energy of ejected gas}}{\text{viscous drag}} = \frac{P\,U_0\,l^2}{\mu\,L}\right.$$

wherein P: gas density
$U_0$: ejection rate
l: chamber width
$\mu$: viscosity coefficient
L: effective decarbonization range a satisfactory circulatory stirring flow can be obtained for a desired decarbonization efficiency and stabilization of the chamber temperature. Also as shown in FIG. 4, a better decarbonization efficiency can be obtained when the lance is moved up and down in the chamber ranging from the upper ejection limit zone through the intermediate zone to the lower ejection limit zone while ejecting the gas from the nozzles, although the result depends on the distribution of the carbon deposition and the amount of the carbon. In order to promote the formation of the circulatory stirring flow from the gas ejected from the nozzles in the chamber, one or more coal charging holes are liberated, or an opening is bored through the pusher side wall or coke side wall of the chamber, or merely the ascension pipe system may be used for the purpose.

Figure 5:
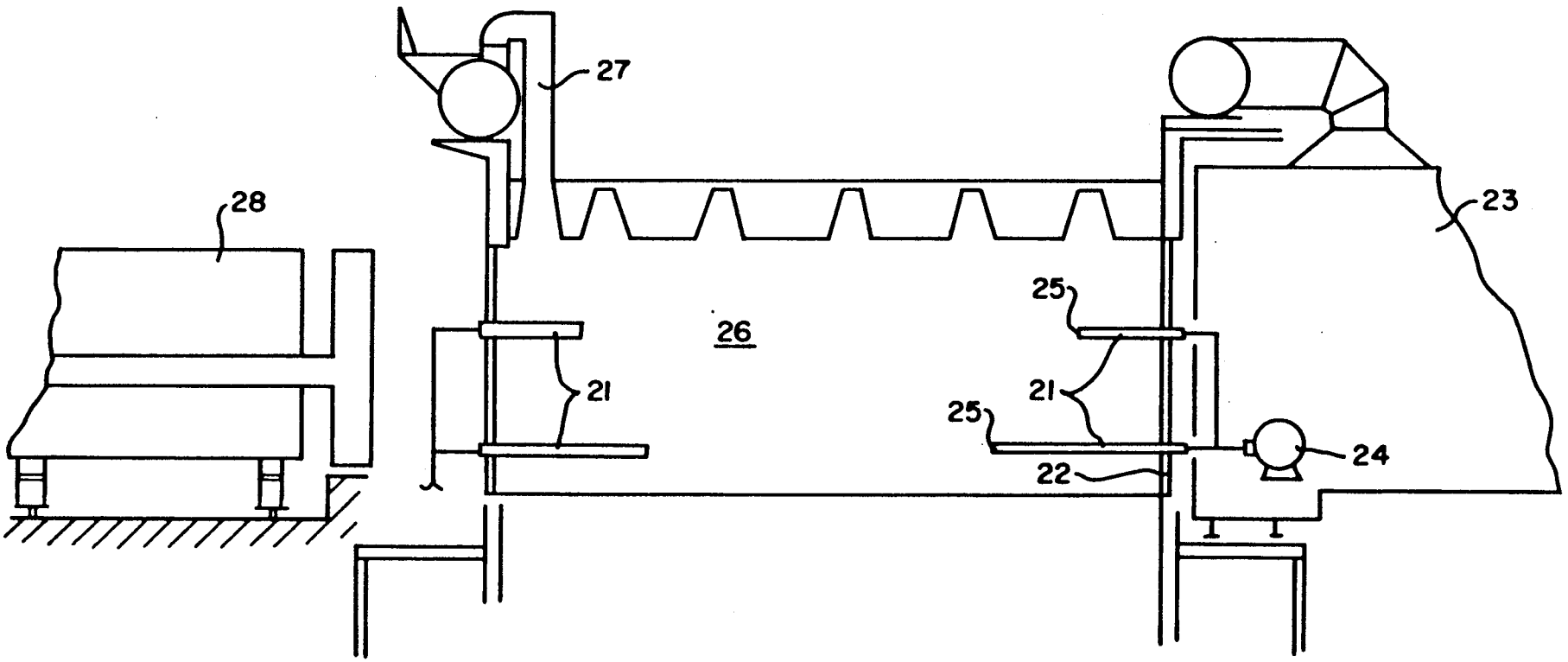
FIG. 5 shows another embodiment of the present invention.
Figure 6A:
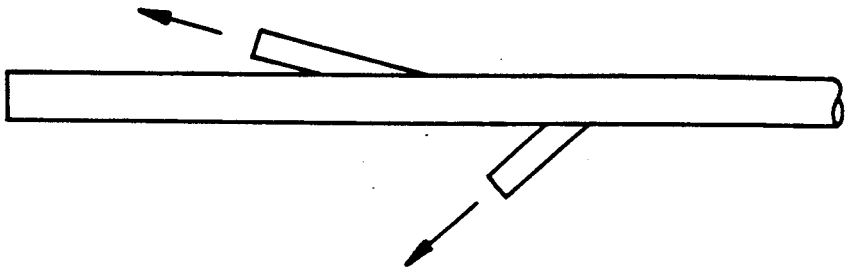
FIGS. 6(*a*), (*b*), (*c*) and (*d*) respectively show various nozzle arrangements on the lance usable in the embodiment shown in FIG. 5.
Figure 6B:
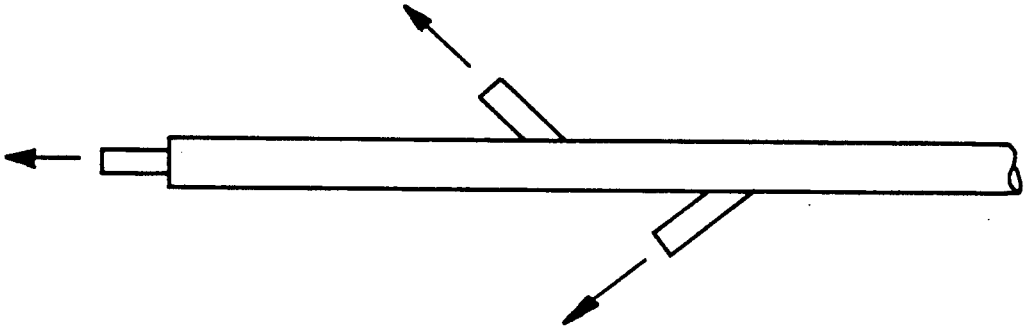
Figure 6C:
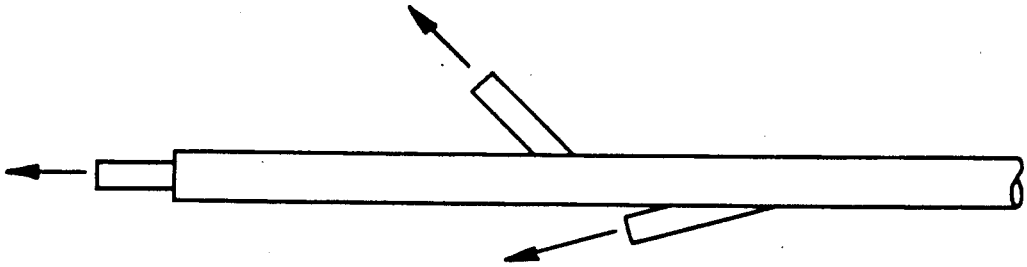
Figure 6D:
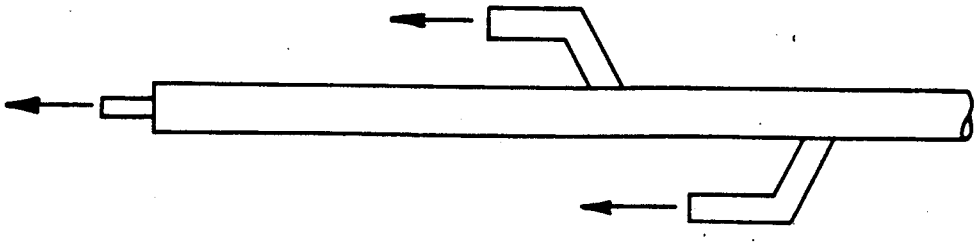

Referring to FIG. 5 showing another embodiment of the present invention, the high-speed gas flow is ejected from through the upper and lower lances 21 carried on the coke guide car 23 into the coking chamber after the coke has been pushed out of the chamber and the carbon combustion gas is discharged through the ascension pipe 27. The lances are inserted into the chamber through a sealing plate 22 and equipped with nozzles 25 at the middle portion and front end portion. The projection direction and shape of the nozzles in this embodiment are as shown in FIGS. 6(*a*), (*b*), (*c*) and (*d*). The nozzle arrangement shown in FIG. 6(*a*) is suitable for insertion at the upper portion of the chamber, the nozzle arrangement shown in FIG. 6(*b*) is suitable for insertion at the middle portion, the one shown in FIG. 6(*c*) is suitable for insertion at the lower portion and the one shown in FIG. 6(*d*) is suitable for insertion both at the upper and lower portions and are advantageous because of the long horizontal portions.

All of the above nozzle arrangements, when the lance is inserted into the coking chamber, form a circulatory stirring flow along the side walls of the chamber.

Preferably, some of the nozzles are projected from the lance with a certain angle so as to eliminate any dead space in the chamber.

Further, the lance is inserted into the chamber aIso from the pusher-side as shown by the dotted line to eject a similar high-speed gas flow to counter the gas flow from the lance inserted from the coke-side. In this way, the stirring effect is advantageously increased by the collision of the counter gas flow.

Figure 7:
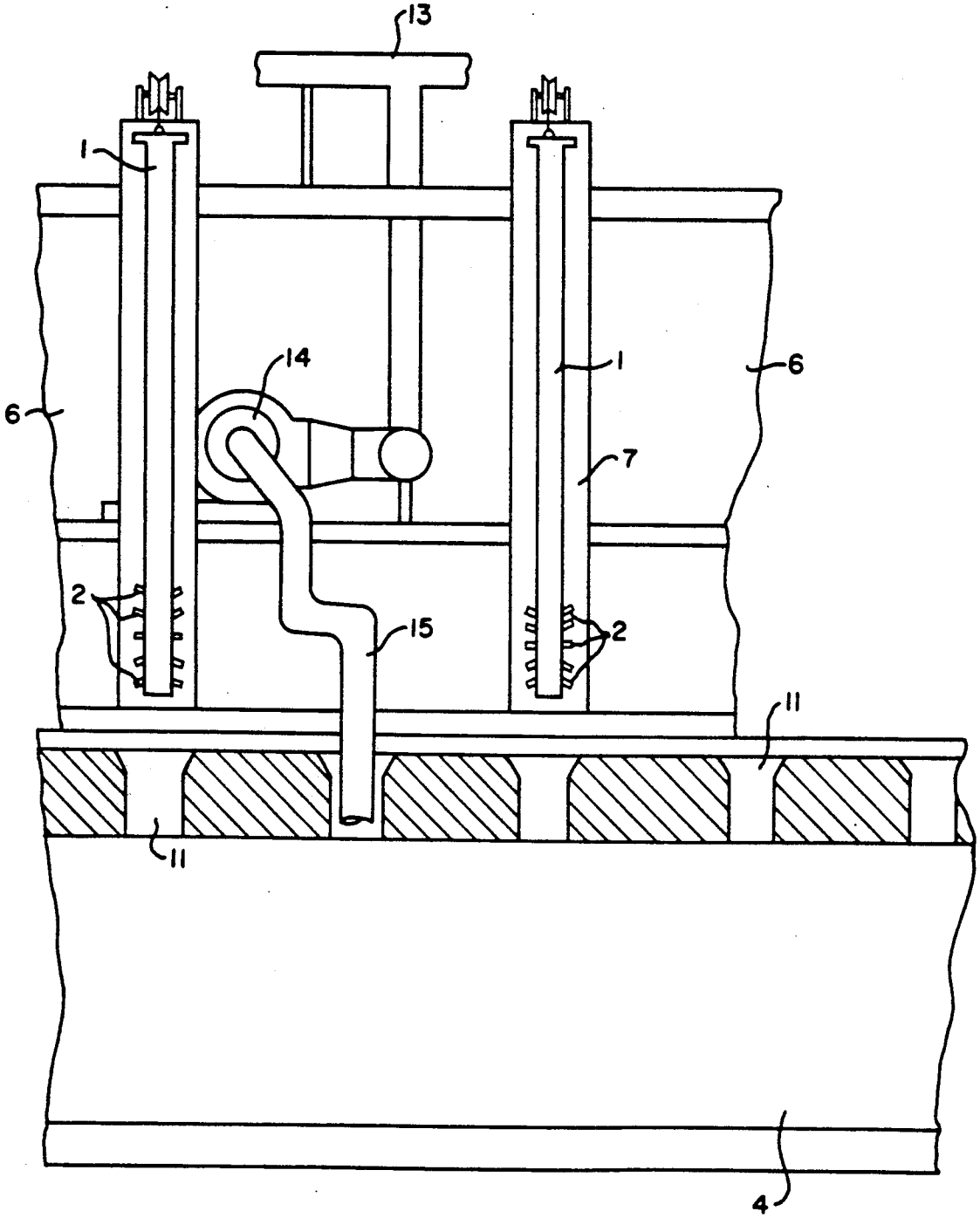
FIG. 7 shows a modification of the present invention in which a plurality of lances are arranged and a gas discharge duct is provided for introducing part of the chamber gas to the oxygen containing gas source.

Referring to FIG. 7 showing a modification of the present invention, a gas discharge duct 15 is connected at one end to the coal charging hole 11 through which the lance is not inserted and the other end is connected to the suction side of a blower, for example, so as to take out part of the combustion gas in the coking chamber and mix it into the supply gas (oxygen or air, or their mixture). In this way, the formation of circulatory stirring flow of the gas ejected from the nozzles 2 over every zone in the coking chamber can be promoted, and the temperature of the gas flow can be raised, thus producing better decarbonization effect.

Figure 8:
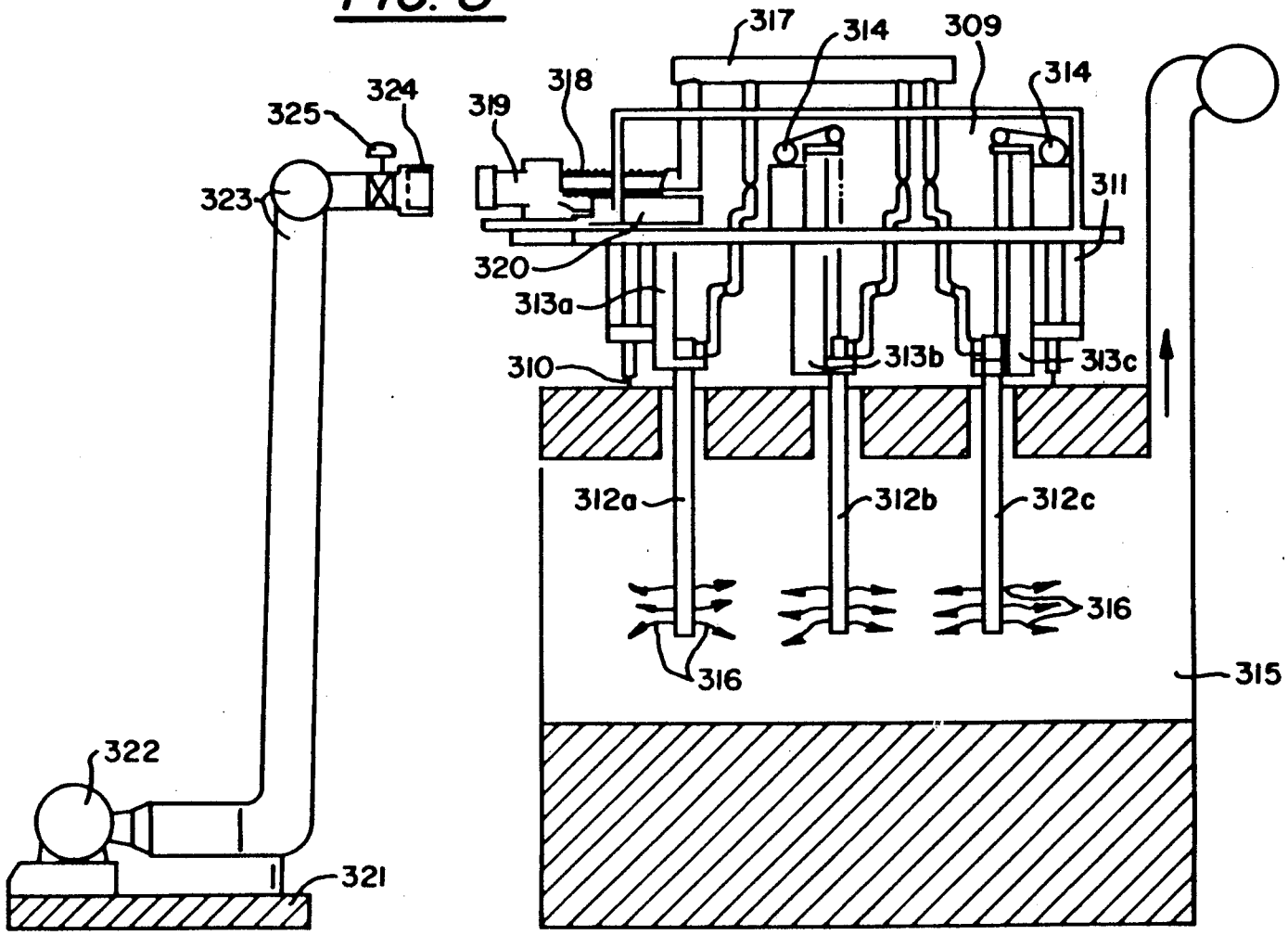
FIGS. 8 and 9 respectively show a further modification of the present invention.
Figure 9:
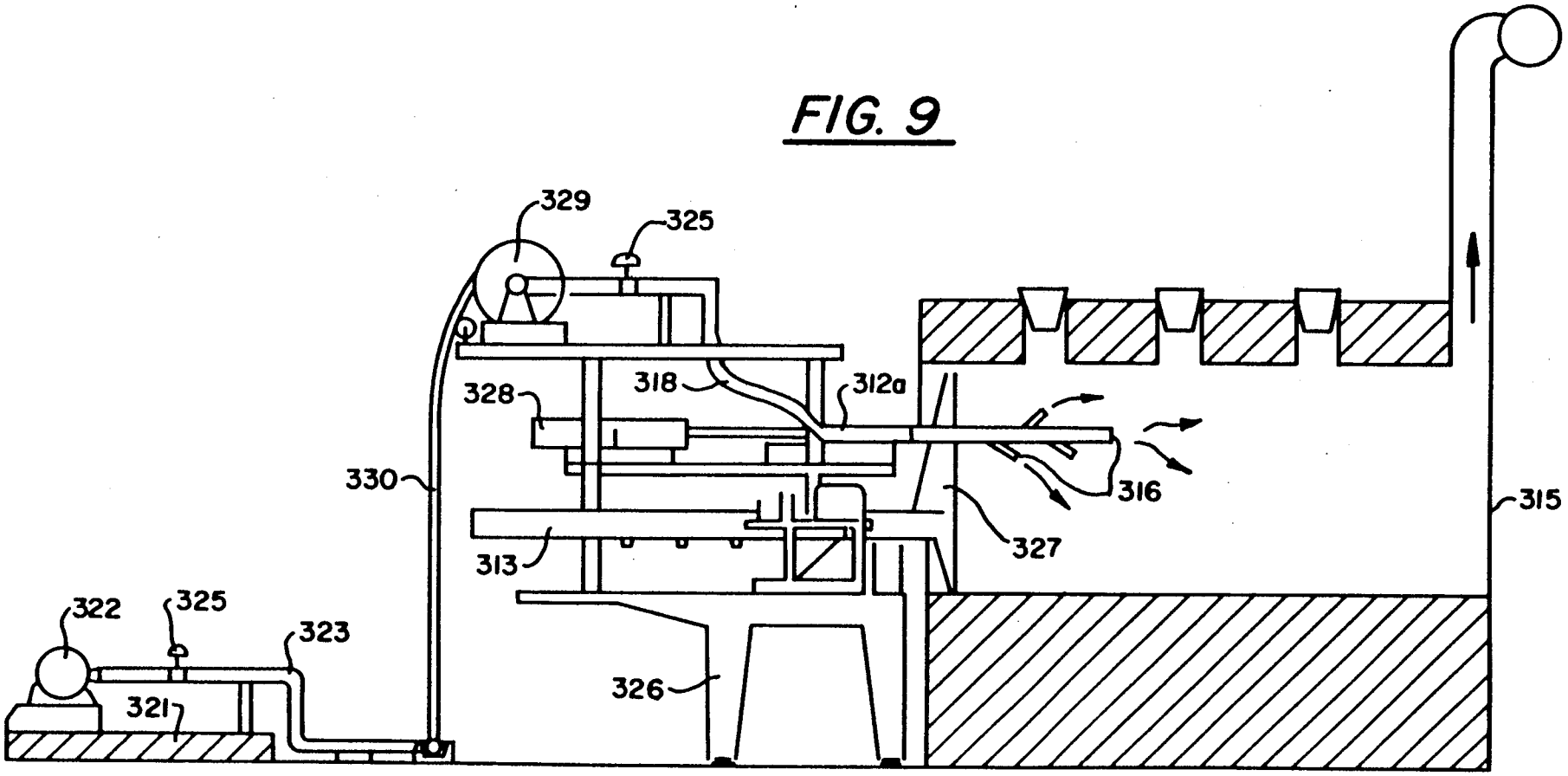

Referring to FIGS. 8 and 9 showing another modification of the present invention, the decarbonization apparatus 309 is shown to comprise a lance carrier car 311 carried by the coal charging car (not shown for clarity) and movable on the rails 310 laid on the coking chamber, lances 312 a to c are supported and guided by lift guides 313 a to c mounted on the car 311, and a winding machine 314 is provided for moving the lances up and down in the coking chamber. The lances are equipped with at least one gas ejection nozzle 316, upward, downward or horizontal, at the lower end portion. The nozzle is arranged so that the ejection direction, when the lance is positioned in the chamber, is oriented parallel to the side walls of the chamber. The upper ends of the lances are connected to a gas supply pipe 317 communicating to a gas supply source as described below. The gas supply pipes are connected to a gas pressure source 322 through a flexible pipe 318, such as a flexible hose, a coupler head 319, a coupler cap 324 and a supply pipe 323. The coupler head 319 is driven forth and back by a shifting device 320 such as a cylinder. Meanwhile, the coupler cap 324 is connected to one end of the supply pipe 323, the other end of which is connected to the gas pressure source 322 such as a compresser and a booster blower. Both the supply pipe and the gas pressure source are mounted on a stationary base 321. The coupler head 319 couples with the coupler cap 324 when it is shifted forth. The coupling between the coupler head and the coupler cap corresponds to the decarbonization operation in the coking chamber and an automatic valve 325 is provided, which opens or closes according to the connection or disconnection between the coupler cap and the coupler head.

Referring to FIG. 9, the lance 312*a* is mounted on a coke pusher 303 carried by a base car 326, and is inserted into coking chamber 315 through an opening of the pusher head 327 by means of a cylinder, or a gear-operated shifting mechanism 328. The lance 312*a* is connected at one end to a flexible pipe 318 connected to an induction duct extending to a winding machine where it communicates to a flexible tube 330 such as a rubber hose and other flexible hoses so that the flexible tube is wound or rewound around the winding machine 329 as the carrier car 326 moves back and forth. The other end of the tube 330 is connected to supply pipe 323 communicating to a gas pressure source 322. The supply of gas is shut manually or automatically by means of an automatic valve 325. In this way, the gas ejection can be satisfactorily performed even if the car carrying the lance is moving.

The decarbonization operation in the above modifications is performed in a similar way as the preceding embodiments.

The above modifications have advantages that the load on the coke oven can be substantially reduced and the capital cost including the maintenance cost can be reduced due to the simplification of the structure and heavy labor can be eliminated due to the automation of the operation.

According to the results of experiments conducted by the present inventors using the apparatus shown in FIG. 2, applied to a coking chamber of 4.0 m in height, 0.4 m in width and 13.4 m in length, the combustion of carbon on all walls of the chamber was visually observed and the current load on the coke pusher lowered from a maximum of 450 A before the decarbonization to a maximum of 230 A after the decarbonization when the decarbonization was performed with an air ejection rate of 80 $N^3$/min. and flow speed of 50 m/s for 60 minutes. It was also confirmed that the waste gas from the flue during the initial stage of the coal charging after the decarbonization did not contain black smoke. This means that the sealing of the refractory joints were complete and was not damaged by the decarbonization. Also the chamber temperature increased from 1035° C. before the decarbonization to 1080° C. after the decarbonization. This means the chamber was not cooled by the decarbonization. The concentration of $CO_2$ in the combustion discharge gas was 15.3% in average. It is estimated from this that the amount of carbon burnt was 393 kg.

What is claimed is:

1. A decarbonization apparatus in combination with a coking chamber in a coke oven for decarbonizing the coking chamber, wherein said coking chamber includes side walls, an interior and an upper wall, said apparatus comprising:

a car movable to and from said coking chamber;

at least one elongated lance member having at least one nozzle disposed substantially parallel to the side walls of the coking chamber for ejecting oxygen-containing gas into an interior of the coking chamber;

a guide for guiding the at least one elongated lance member into and out of a charging hole in the upper wall of the coking chamber;

means for controllably moving the at least one alongated lance member up and down on said guide and into and out of the interior of the coking chamber; and blower means for supplying oxygen containing gas to said at least one elongated lance member.

2. A decarbonization apparatus according to claim 1, wherein said blower means is couplable on a suction side thereof to a hole defined in a wall of the coking chamber so as to remove gas from therewithin.

3. A decarbonization apparatus according to claim 1, wherein said at least one elongated lance member is connectd to said blower means with a flexible pipe and a coupler.

4. A decarbonization apparatus according to claim 1, wherein said at least one elongated lance member is connected to said blower means with a flexible tube, said car including means for winding and unwinding said flexible tube as the car moves.

* * * * *